US005547527A

United States Patent [19]

Müller et al.

[11] Patent Number: 5,547,527

[45] Date of Patent: Aug. 20, 1996

[54] PROCESS FOR THE PRODUCTION OF DESENSITIZED EXPLOSIVES

[75] Inventors: Dietmar Müller, Karlsruhe; Mathias Helfrich, Landau; Michael Mandt, Karlsruhe, all of Germany

[73] Assignee: Fraunhofer Gesellschaft zur Forderung der angewandten Forderung der angewandten Forschung e.V., Munich, Germany

[21] Appl. No.: 106,789

[22] Filed: Aug. 16, 1993

Related U.S. Application Data

[63] Continuation of Ser. No. 844,544, Mar. 2, 1992, abandoned.

[30] Foreign Application Priority Data

Apr. 11, 1991 [DE] Germany ..... 41 11 752.2

[51] Int. Cl.[6] ..... C06B 45/10; C06B 21/00

[52] U.S. Cl. ..... 149/19.92; 149/11; 264/3.1; 264/3.2

[58] Field of Search ..... 149/11, 19.92; 264/3.1, 3.2

[56] References Cited

U.S. PATENT DOCUMENTS

| | | | |
|---|---|---|---|
| 1,007,276 | 10/1911 | Du Pont | 264/3.4 |
| 1,036,906 | 8/1912 | Reuter | 264/3.4 |
| 2,438,281 | 3/1948 | Gordon | 264/3.2 |
| 3,266,957 | 8/1966 | Stresau | 149/11 |
| 3,296,041 | 1/1967 | Wright | 149/19.3 |
| 3,338,764 | 8/1967 | Evans | 149/19.91 |
| 3,348,986 | 10/1967 | Sauer | 149/11 |
| 3,428,502 | 2/1969 | Evans | 149/19.91 |
| 3,586,551 | 6/1971 | Nolan | 149/2 |
| 3,740,278 | 6/1973 | Sakreis et al. | 149/11 |
| 4,092,187 | 5/1978 | Hildebrant et al. | 149/11 |
| 4,113,811 | 9/1978 | Helfgen | 149/19.91 |
| 4,163,681 | 8/1979 | Rothenstein et al. | 149/11 |
| 4,376,083 | 3/1983 | Ulsteen | 149/11 |
| 4,405,534 | 9/1983 | Friedrich-Ulf | 149/19.4 |
| 4,428,786 | 1/1984 | Arni | 149/21 |
| 4,488,916 | 12/1984 | Wanninger | 149/2 |
| 4,882,994 | 11/1989 | Veltman et al. | 149/19.92 |
| 4,997,614 | 3/1991 | Kishi | 264/3.2 |

FOREIGN PATENT DOCUMENTS 152280 2/1985 European Pat. Off. .

OTHER PUBLICATIONS

*Chemical Abstracts,* vol. 070, No. 24, 16 Jun. 1969, Columbus, Ohio US; Abstract No. 107929G "Solid Self-supporting Explosives".

Meyer, "Explosives", pp. 116–117, (Weinheim, New York) Verlog Chemic (1977).

*Primary Examiner*—Edward A. Miller

*Attorney, Agent, or Firm*—Antonelli, Terry, Stout & Kraus

[57] ABSTRACT

In a process for the production of desensitized, high energy explosive, particularly hexogen (RDX), as a component of plastic-bound explosives or propellant powders, the particulate explosive with a grain size up to 20 μm is suspended with a desensitizing polymer in aqueous dispersion, the slurries are applied to a rotary, heated roller, the applied material is dried at a temperature of >100° C. and is scraped from the roller after drying.

23 Claims, No Drawings

PROCESS FOR THE PRODUCTION OF DESENSITIZED EXPLOSIVES

This application is a continuation of application Ser. No. 07/844,544, filed Mar. 2, 1992, and now abandoned.

The invention relates to a process for producing desensitized, high energy explosive, particularly hexogen (RDX) or octogen (HMX), as a component of plastic-bound explosives or propellants, in that the particulate explosive is coated with a desensitizing polymer from the aqueous phase.

It is known in connection with explosives and plastic-bound explosives to admix as essential components high energy explosives, such as hexogen, octogen, etc. Hexogen and octogen are characterized by a high energy or shattering power which is determinative for their use, but which leads to considerable processing problems. The high friction and impact sensitivities lead to a correspondingly high safety risk. The wider the particle size distribution and the larger the coarse particle fraction, the higher the said safety risk, because individual grain detonations can e.g. take place in an explosive powder. Such individual grain detonations are also undesired in use, particularly in the case of use in LOVA propellants. The coarse particle fraction in the case of burn-off interruptions of propellants, e.g., leads to perforation burns, so that the propellant body geometry changes in an uncontrolled manner and there is consequently a negative influence on the burn-off behaviour and the ballistics.

In order to reduce safety risks when processing and also the use disadvantages, it is known to desensitize these high energy explosives (DE-OS 37 11 995). For this purpose the explosive is moistened and is e.g. coated with wax in a forced-action mixer, accompanied by a simultaneous heating. It is also known to coat the particulate explosive in a kneader or mixer with a desensitizer in the liquid phase. For this purpose the desensitizer is dissolved with a solvent with respect to which the explosive is insoluble or only slightly soluble. The granular explosive is mixed into the solution close to its boiling point.

After drawing off the solvent and any moisture still present, granulation takes place in the same mixer. This takes place within the framework of pelletizing, in that with a grain distribution between 1 and 100 μm, the grain fraction up to 50 μm is separately granulated and agglomerated and coated with a joint desensitizing coating, whereas the coarser particles are individually coated with the desensitizer. In the case of hexogen (RDX), a wax is proposed as the desensitizer and is dissolved in perchloroethylene. In addition, graphite powder is added, which also has a desensitizing action and in particular prevents electrostatic charges.

A high energy explosive produced in this way has a wide particle size distribution with a high coarse particle fraction, which not only has the aforementioned disadvantages when processing, but is also responsible for certain use shortcomings. These explosives can also not be added in the otherwise very advantageous processing of propellants and explosive mixtures in extruders, particularly twin screw extruders, because the safety risk is too high.

Finally, it is known (DE-C-39 34 368), to directly incorporate the desensitizer into the explosive particles, in that the explosive is dissolved and in the dissolved form mixed with the desensitizer in the liquid phase and the mixture is brought by spray drying into the solid phase with a particle size up to 5 μm. Dibutyl phthalate (DBP) or di-(2-ethyl hexyl)-adipinat (DOA) are e.g. used as desensitizers. The friction sensitivity, which is the decisive physical quantity for safe processing in the extruder, is 30 kg when using DOA and 14.4 kg pin load when using DBP. A disadvantage of this process is working with solvents, which requires corresponding precautions for respecting the admissible workplace concentrations, as well as for avoiding harm to the environment.

The problem of the present invention is to propose a process of the aforementioned type, which on the one hand does not use solvents which are prejudicial to the environment and on the other leads to desensitized explosives with reduced friction sensitivity.

According to the invention this problem is solved in that the particulate explosive with a particle size up to 20 μm is suspended with the polymer in aqueous dispersion, the slurries are applied to a rotary, heated roller, the applied product is dried at ambient pressure at a temperature of >100° C. and is scraped from the roller after drying.

The inventive process can be performed continuously and requires no special precautions regarding the protection of the workplace and environment, because working occurs in the aqeuous phase. In conjunction with the limited particle size, a homogeneous dispersion can be obtained, which can be applied to the roller without any safety risks and is dried at ambient pressure by evaporating. After scraping off the dried layer, the explosive particles are homogeneously coated with the polymer. The desensitizing polymer preferably simultaneously forms the plastic binder for the finished explosive or propellant, the polymer being added in the quantity necessary for the end product or part thereof.

It has proved particularly advantageous to choose the polymer from the group styrene-1,3-butadiene-acrylonitrile, vinyl propionate-acrylate and the polymer preferably used in a 50 to 55% aqueous dispersion. Instead of this polyvinyl alcohol can be used as the polymer and the aqueous dispersion also contains glycerol.

Preferably a surface-active additive is added to the aqueous dispersion. For example, the surface-active additive can be highly dispersed, amorphous silicon dioxide.

As a result of its surface-active action, the aforementioned additive prevents the formation of steam bubbles, which in turn lead to the cracking and possibly flaking off of the layer. The flowability and the quality of the application are also improved.

An adequate desensitization is obtained if the explosive is suspended with 5 to 25% by weight of polymer in an aqueous dispersion.

The explosive is preferably used with a grain size up to 10 μm and the particle size distribution can also be in the range of 3 to 5 μm.

The slurries applied to the roller are preferably dried at a roller temperature between 110° and 150° C., particularly <140° C. and as a result relatively short residence times can, be obtained. They can e.g., be in the range of 60 s and slightly higher, when using a roller of at least 150 cm and in which the layer thickness is <10 mm.

An inventive desensitized RDX with a higher polymer content, e.g. in the range 15 to 25%, can be directly used as a basic granular material during the extrusion of LOVA propellant powders.

In the enclosed Table I is shown a test series with hexogen (RDX) of particle size of 10 μm and different polymers and giving the friction sensitivity and impact sensitivity found. The desensitizers are indicated by capital letters, which are explained in the table footnote.

The best results as regards impact and friction sensitivity are provided by the test examples with 75% by weight RDX and a dispersion from 15% by weight polymer D, 10% by weight glycerol and water. The friction sensitivity is at above 36 kg pin loading and the impact sensitivity at 0.55 kgm.

Similar good results with regards to the friction sensitivity are provided by the example with 75% by weight RDX and 25% by weight polymer A dispersed in water. In this case, the impact sensitivity is 0.35 kgm.

Even in the case of a very high hexogen content of 90%, using 10% by weight polymer A, dispersed in water, a friction sensitivity of 32.4 kg pin load and an impact sensitivity of 0.30 kgm were found.

Table II gives the corresponding data for a hexogen having a smaller particle size (5 μm). In all test series commercial "Aerosil 200" (highly dispersed, amorphous silicon dioxide was added). This is a silicic acid-based thickener, which leads to a uniform distribution of the application on the roller and prevents the cracking off of the layer drying on the roller.

TABLE I

| | 1 | 2 | 3 | 4 | 5 | 6 | 7 |
|---|---|---|---|---|---|---|---|
| RDX 10 μm (% by weight) | 90 | 75 | 90 | 75 | 90 | 75 | 100 |
| A (% by weight) | 10 | 25 | | | | | |
| B (% by weight) | | | | | 10 | 25 | |
| C (% by weight) | | | 5 | 15 | | | |
| Glycerol (% by weight) | | | 5 | 10 | | | |
| $+H_2O$ 100–500 -% by weight | | | | | | | |
| Friction sensitivity kg | 25.2 (1 × pos.) | 36 (no reaction) | 25.2 (2 × pos.) | 36 (no reaction) | 19.2 (1 × pos.) | 32.4 (1 × pos.) | 13 (3 × pos.) |
| Impact sensitivity kgm | 0.30 | 0.35 | 0.30 | 0.55 | 0.25 | 0.30 | 0.20 |

A = Styrene-1,3-butadiene-acrylonitrile dispersion (50%)
B = Vinyl propionate-acrylate dispersion (55%)
C = Polyvinyl alcohol (PVA1)

TABLE II

| | 1 | 2 | 3 | 4 |
|---|---|---|---|---|
| RDX (5 μm) (% by weight) | 95 | 95 | 95 | 100 |
| A (% by weight) | 4.5 | | | |
| B (% by weight) | | 4.5 | | |
| C (% by weight) | | | 2.25 | |
| Glycerol (% by weight) | | | 2.25 | |
| Aerosil 200 | 0.5 | 0.5 | 0.5 | |
| $+H_2O$ 100–500 (% by weight) | | | | |
| Friction sensitivity | 24 (1 × pos) | 24 (2 × pos.) | 22 (1 × pos.) | 15 (3 × pos) |
| Impact sensitivity | 0.25 | 0.25 | 0.25 | 0.2 |

We claim:

1. A process for the production of desensitized, high energy explosive, adapted to be used as a component of plastic-bound explosives or propellants, comprising providing a particulate explosive with a grain size up to 20 μm; suspending the particulate explosive with a desensitizing polymer and a surface active additive in an aqueous dispersion to form a slurry, the surface active additive being amorphous silicon dioxide; applying the slurry to a rotary, heated roller; drying the applied slurry at ambient pressure and at a temperature between 100°and 150° C.; and scraping the dried slurry from the roller to thereby provide the particulate explosive coated with the desensitizing polymer.

2. Process according to claim 1, wherein the desensitizing polymer is chosen from the group consisting of styrene-1, 3-butadiene-acrylonitrile and vinyl propionate-acrylate.

3. Process according to claims 1 or 2, wherein a concentration of the desensitizing polymer in the aqueous dispersion is 50 to 55%.

4. Process according to claim 1, wherein the desensitizing polymer is polyvinyl alcohol and the aqueous dispersion also contained glycerol.

5. Process according to claim 1, wherein the particulate explosive is suspended with 5 to 25% by weight polymer in the aqueous dispersion.

6. Process according to claim 1, wherein the particulate explosive has a grain size up to 10 μm.

7. Process according to claim 1, wherein the slurry applied to the roller is dried at a temperature between 110° and 140° C.

8. Process according to 1, wherein the roller has a circumference of at least 150 cm and the residence time of the slurry on the roller is >60 s.

9. Process according to claim 8, wherein the roller has a layer thickness of <10 mm.

10. A process according to claim 1, wherein said particulate explosive is selected from the group consisting of hexogen (RDX) and octogen (HMX).

11. A process according to claim 10, wherein said particulate explosive is hexogen (RDX).

12. A process according to claim 10, wherein said particulate explosive is octogen (HMX).

13. Process according to claim 1, wherein the slurry applied to the roller is dried at a temperature between 110° and 150° C.

14. Process according to claim 2, wherein the slurry applied to the roller is dried at a temperature between 110° and 150° C.

15. Process according to claim 3, wherein the slurry applied to the roller is dried at a temperature between 110° and 150° C.

16. Process according to claim 4, wherein the slurry applied to the roller is dried at a temperature between 110° and 150° C.

17. Process according to claim 5, wherein the slurry applied to the roller is dried at a temperature between 110° and 150° C.

18. Process according to claim 6, wherein the slurry applied to the roller is dried at a temperature between 110° and 150° C.

19. Process according to claim 8, wherein the slurry applied to the roller is dried at a temperature between 110° and 150° C.

20. Process according to claim 9, wherein the slurry applied to the roller is dried at a temperature between 110° and 150° C.

21. Process according to claim 10, wherein the slurry applied to the roller is dried at a temperature between 110° and 150° C.

22. Process according to claim 11, wherein the slurry applied to the roller is dried at a temperature between 110° and 150° C.

23. Process according to claim 12, wherein the slurry applied to the roller is dried at a temperature between 110° and 150° C.

* * * * *